United States Patent [19]

Roder

[11] 4,136,588

[45] Jan. 30, 1979

[54] ALIGNED SLIDING JAW KEY SET

[76] Inventor: Peter G. Roder, 243 No. 16th St., San Jose, Calif. 95112

[21] Appl. No.: 781,499

[22] Filed: Mar. 25, 1977

[51] Int. Cl.[2] ..... B25B 13/12

[52] U.S. Cl. ..... 81/165; 279/67

[58] Field of Search ..... 81/130 R, 128, 155, 81/165; 279/67, 68

[56] References Cited

U.S. PATENT DOCUMENTS

| | | | |
|---|---|---|---|
| 1,432,263 | 10/1922 | Schlutz | 81/165 |
| 3,385,142 | 5/1968 | Cunningham | 81/130 R |
| 3,724,299 | 4/1973 | Nelson | 81/128 |
| 3,774,482 | 11/1973 | Morin | 81/165 |

*Primary Examiner*—Nicholas P. Godici

*Attorney, Agent, or Firm*—John J. Leavitt

[57] ABSTRACT

Aligned sliding jaw key set for use with any standard ratchet wrench. The device is adaptable to being made up in kits that include three jaw keys in different sizes so that they replace nine to twelve solid sockets of different sizes in metric and American standards. Each of the jaw keys has a set of jaws each one of which is provided with an angular gripping portion able to fit and hold tightly onto the sides of nuts and bolts.

8 Claims, 6 Drawing Figures

ALIGNED SLIDING JAW KEY SET

BACKGROUND OF THE INVENTION

1. Field of the invention

This invention relates to tools in general and more particularly to chucks and adjustable sockets.

2. Description of the Prior Art.

The prior art relating to this invention is believed to be located in Class 81, sub-classes 114, 128, 129, 130, 130R, 155, 165 and 279/36.

The subject matter of this invention comprises; an adjusting device such as a set of movable parts that in combination cooperate to move a pair of jaws to expand or reduce their diametrical width to create various size gripping devices. Such jaw keys are useful in combination with ratchet wrenches and the like for the purpose of adjusting various size nuts and bolts. The prior art sockets had certain limitations. In one prior patent the combination consisted of many parts and bulky housing, making it costly to manufacture and almost useless in work. Therefore, one of the objects of this invention is to provide a set of jaw keys for use in adjusting nuts and bolts, without having to exclude standard sockets, and that are able to do the same work as the standard sockets with less disadvantages.

Another object of the present invention is to provide a set of jaw keys without the costly arrangement of many parts or bulky housing.

Furthermore, a third important object of the present invention is to provide a set of jaw keys that are able to aid in a large variety of working conditions.

SUMMARY OF THE INVENTION:

In terms of broad inclusion the present invention comprises a set of jaw keys for use with ratchet wrenches and the like. The jaw keys include a cylindrical center piece having a square drive aperture at its top and a slide groove at the bottom. Two jaw slides or jaw members slidably engage said slide groove. A combination of gears cooperate to move said jaws within said slide groove. A cylindrical tube is placed over said cylindrical center piece and is arranged to move said set of gears to effect rotation thereof to cause the jaw members to move.

Figure 4:
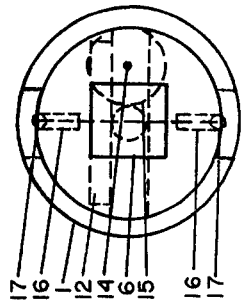
FIG. 4 is a top plan view.
Figure 5:
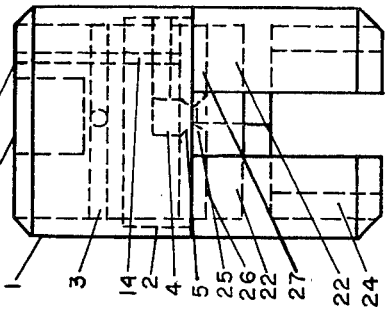
FIG. 5 is a side elevational view illustrating underlying structure in broken lines.
Figure 6:
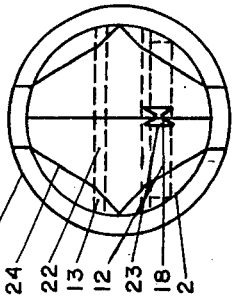
FIG. 6 is a bottom plan view. DESCRIPTION OF THE PREFERRED EMBODIMENT
Figure 2:
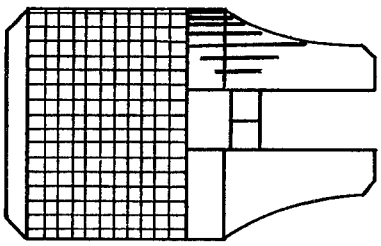
FIG. 2 is a side elevational view.
Figure 3:
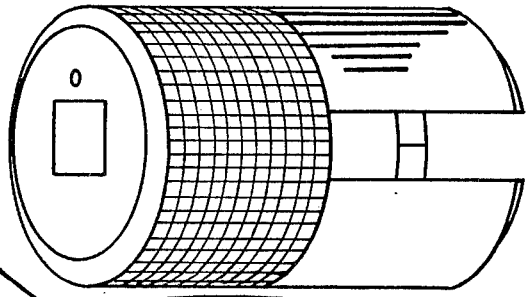
FIG. 3 is a side elevational view illustrating how a larger bolt or nut may be accommodated.
Figure 1:
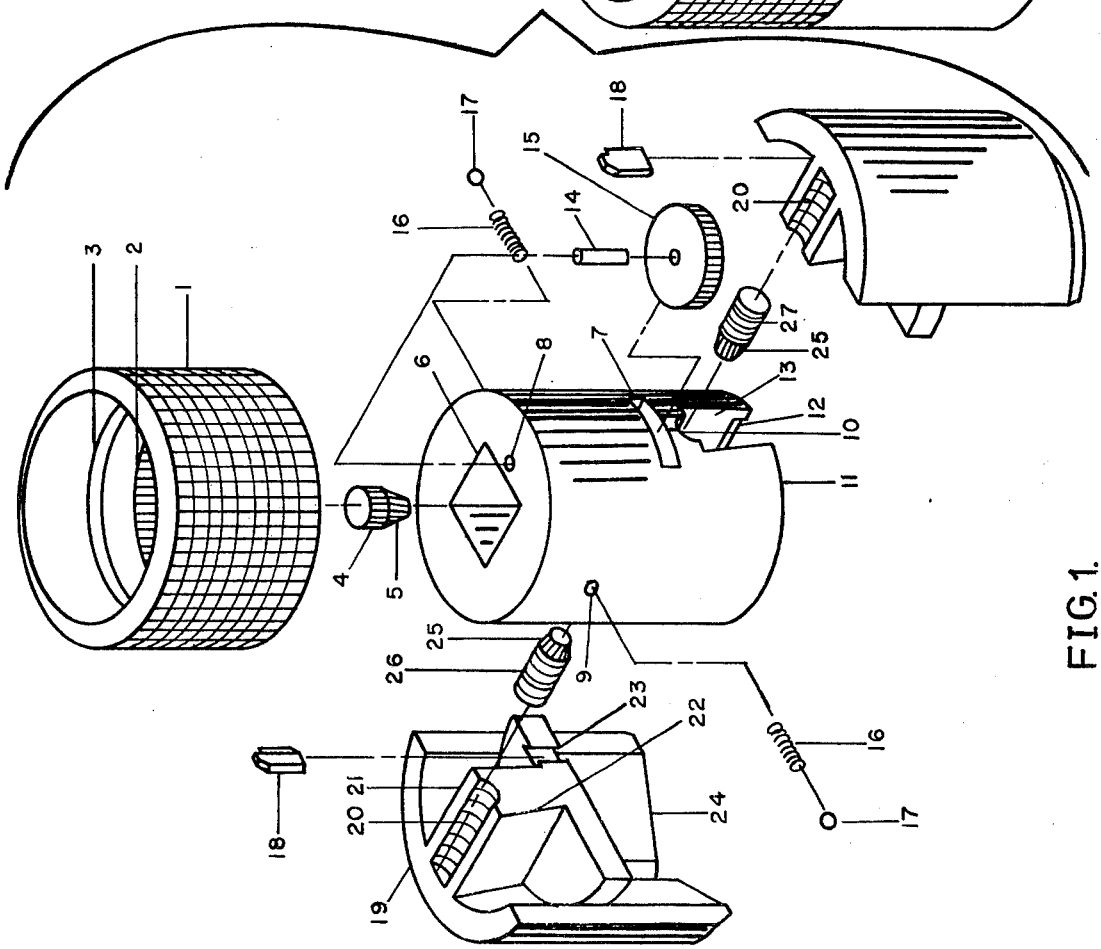
FIG. 1 is an exploded view in perspective illustrating in detail the association of the parts comprising the present invention.

In terms of greater detail, the aligned sliding jaw key set of the present invention comprises a cylindrical tube 1 having a circular groove 3 in the top inner surface and a geared bottom portion 2 also in the inner surface. The cylindrical tube 1 is placed over a cylindrical center piece 11 having a square aperture drive 6 in its top and a slide groove 13 that extends radially across the bottom center. The slide groove 13 is being narrowed towards the bottom end the cylindrical center piece and is provided with a bumper slide 12 formed in one of its sides at the bottom thereof. The slide groove 13 has a ¼ closed semicylindrical bore 10 formed across at its top center providing a housing for two oppositely threaded slide motivating studs 26 and 27 each having gear teeth 25 formed on their inner ends. The semi-cylindrical threaded extending ⅓ surface of said slide studs are aligned to ⅓ deep threaded semi-cylindrical hollows 20 located at the top of the jaw slides 22. The jaw slides 22 are integral with a transverse semi-circular strengthening support 21 at their bottom surfaces, the support 21 having a bumper pin slot formed therein as shown. Below the semi-circular support wall 21 there is formed a jaws gripping section 24 having an angular inner surface that conforms to square and hexagon shaped nuts and bolts. A bumper pin 18 is forced, i.e. press fitted into said bumper pin slot 23 after the jaw slides 22 are slid into their respective slide grooves 13 to prevent over extension.

A main gear having an angularly narrowed or tapered gear end 5 and a vertically geared cylindrical side 4 is centered and aligned with the slide gear stud's geared ends 25 and the vertically geared side 4 of said main gear is aligned to a drive gear 15 placed into a slot in the cylindrical center piece 11 and held in centered rotating position by a shaft 14 placed vertically through the drive gear's center and a bore 8 extending to the top of said cylindrical center piece 11. Two ball bearings 17 each with a spring 16 placed into their respective sockets 9 to provide resilient pressure and rotating ability for said cylindrical tube 1 as said ball bearings 17 are embedded in the circular groove 3 formed into the inner surface of said cylindrical tube. The bottom geared inner end 2 of the cylindrical tube 1 is in contact alignment with the extending portions of drive gears 15. As the cylindrical tube 1 having knurling on its outer surface is turned, the combination of gears move the jaws 19 to expand or reduce them in diametrical width to form various size gripping jaws.

It is obvious that minor changes may be made in the form and construction of the invention without departing from the material spirit thereof, it is not desired to confine the invention to the exact form herein shown and described, but it is desired to include all such forms as properly come within scope claimed. The invention having been thus described, what is claimed as new and desired to be secured by patent letters is as follows:

I claim:

1. A chuck-type tool for grasping nuts and bolts for the purpose of imposing torque thereon; comprising:

(a) a cylindrical center piece having a longitudinal axis and having therein drive means adapted to receive a drive handle;

(b) a slide groove formed in said cylindrical center piece and extending diametrically thereacross;

(c) at least two jaw members mounted on said cylindrical center piece for radially directed movement in relation thereto, each said jaw member including a slide member slidably engaging said slide groove and a jaw section presenting two angularly disposed gripping surfaces thereon facing corresponding gripping surfaces on the other jaw member;

(d) means rotatably journaled on said cylindrical center piece operatively associated with said jaw members and selectively manipulable to effect movement of said jaw members toward or away from each other to decrease or increase the space between said gripping surfaces; and (e) each said jaw member including an axially extending semi-cylindrical body portion having an inner peripheral surface divided longitudinally by a transversely extending semi-circular integral support wall to define an upper support portion including said slide member and a lower jaw section, said slide member being integral with said inner peripheral surface of the semi-cylindrical body portion and the side of said support wall remote from said jaw section.

2. A chuck-type tool for grasping nuts and bolts for the purpose of imposing torque thereon, comprising:

(a) a cylindrical center piece having a longitudinal axis and having therein drive means adapted to receive a drive handle;

(b) a slide groove formed in said cylindrical center piece and extending diametrically thereacross;

(c) at least two jaw members mounted on said cylindrical center piece for radially directed movement in relation thereto, each said jaw member including a slide member slidably engaging said slide groove and a jaw section presenting two angularly disposed gripping surfaces thereon facing corresponding gripping surfaces on the other jaw member;

(d) means rotatably journaled on said cylindrical center piece operatively associated with said jaw members and selectively manipulable to effect movement of said jaw members toward or away from each other to decrease or increase the space between said gripping surfaces; and (e) each said jaw member including an axially extending semi-cylindrical body portion having an inner peripheral surface divided longitudinally by a transversally extending semi-circular integral support wall to define a support portion adjacent one end of said jaw member and a jaw section adjacent the other end thereof, the two angularly disposed gripping surfaces of said jaw section defining chords intercepting adjacent portions of the inner periphery of said jaw section.

3. A chuck-type tool for grasping nuts and bolts for the purpose of imposing torque thereon, comprising:

(a) a cylindrical center piece having a longitudinal axis and having therein drive means adapted to receive a drive handle:

(b) a slide groove formed in said cylindrical center piece and extending diametrically thereacross;

(c) at least two jaw members mounted on said cylindrical center piece for radially directed movement in relation thereto, each said jaw member including a slide member slidably engaging said slide groove and a jaw section presenting two angularly disposed gripping surfaces thereon facing corresponding gripping surfaces on the other jaw member;

(d) means rotatably journaled on said cylindrical center piece operatively associated with said jaw members and selectively manipulable to effect movement of said jaw members toward or away from each other to decrease or increase the space between said gripping surfaces; and (e) said means rotatably journaled on said cylindrical center piece and operatively associated with said jaw members including a pair of oppositely threaded studs rotatably disposed in said slide groove between said cylindrical center piece and said slide members, said threaded studs including oppositely disposed end portions having gear teeth formed thereon, a main gear rotatably disposed in said cylindrical center piece and drivingly engaging the studs, a drive gear journaled on said cylindrical center piece and drivingly engaging said main gear, and a cylindrical tube rotatably journaled about said cylindrical center piece and including a toothed section drivingly engaging said drive gear whereby rotation of said cylindrical tube effects lateral translation of said jaw members.

4. The combination according to claim 3, in which said oppositely threaded studs are axially aligned and transversely disposed in relation to said cylindrical center piece and said jaw members.

5. The combination according to claim 3, in which said culindrical center piece is provided with a transversely extending slot, and said drive gear is journaled in said slot whereby its outer periphery engages said main gear and said cylindrical tube.

6. The combination according to claim 3, in which spring pressed detent means are provided disposed between said cylindrical center piece and said cylindrical tube to retain said cylindrical tube on said cylindrical center piece against axial displacement.

7. The combination according to claim 3, in which stop means are mounted on said jaw members to limit the transverse excursion thereof.

8. The combination according to claim 7, in which said stop means includes a stop lug press-fitted on each said jaw member and an abutment formed on said cylindrical center piece against which the stop lug may impinge.

* * * * *